United States Patent [19]

Lipani

[11] 4,252,881

[45] Feb. 24, 1981

[54] DEVELOPER MIXTURE

[75] Inventor: Anthony F. Lipani, Webster, N.Y.

[73] Assignee: Xerox Corporation, Stamford, Conn.

[21] Appl. No.: 968,526

[22] Filed: Dec. 11, 1978

Related U.S. Application Data

[62] Division of Ser. No. 327,391, Jan. 29, 1973, abandoned.

[51] Int. Cl.[3] ..... G03G 9/10

[52] U.S. Cl. ..... 430/108; 430/111; 430/120

[58] Field of Search ..... 252/62.1 P; 430/120–126, 108, 111

[56] References Cited

U.S. PATENT DOCUMENTS

| | | | |
|---|---|---|---|
| 3,725,283 | 4/1973 | Fenity | 252/62.1 P |
| 3,767,477 | 10/1973 | McCabe et al. | 427/18 |
| 3,900,587 | 8/1975 | Lenhard et al. | 252/62.1 P |
| 3,947,370 | 3/1976 | Miller | 252/62.1 P |
| 4,038,076 | 7/1977 | Lipani | 252/62.1 P |

*Primary Examiner*—Morris Kaplan

*Attorney, Agent, or Firm*—Harvey M. Brownrout; Peter H. Kondo; James F. Tao

[57] ABSTRACT

An electrostatographic developer mixture comprising finely divided toner particles, and steel bead carriers whose surfaces are carburized, or nitrided or carburized-nitrided.

6 Claims, No Drawings

DEVELOPER MIXTURE

This application is a division of my pending application Ser. No. 327,391, entitled "Composite Electrostatic Carrier Particles", filed Jan. 29, 1973, now abandoned.

BACKGROUND OF THE INVENTION

This invention relates, in general, to electrostatographic imaging systems, and, in particular to improved developer materials and their use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely divided electroscopic material referred to in the art as "toner". The toner will normally be attracted to those areas of the layer which retain a charge thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is known as "cascade" development. In this method a developer material comprising relatively large carrier particles having finely divided toner particles electrostatically clinging to the surface of the carrier particles is conveyed to and rolled or cascaded across the electrostatic latent image bearing surface. The composition of the toner particles is so chosen as to have a triboelectric polarity opposite that of the carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method a developer material containing toner and magnetic carrier particles is carried by a magnet. The magnetic field of the magnet causes alignment of the magnetic carriers in a brushlike configuration. This "magnetic brush" is engaged with an electrostatic latent image bearing surface and the toner particles are drawn from the brush to the electrostatic latent image by electrostatic attraction.

Another technique for developing electrostatic latent images is the "touchdown" process as disclosed, for example, in U.S. Pat. Nos. 2,895,847, and 3,245,823 to Mayo. In this method a developer material is carried to a latent image bearing surface by a support layer such as a web or sheet and is deposited thereon in conformity with said image.

It has been ascertained that in order to develop a latent image comprised of negative electrostatic charges, an electroscopic powder and carrier combination should be selected in which the powder is triboelectrically positive to the granular carrier; and to develop a latent image comprised of positive electrostatic charges, an electroscopic powder and carrier should be selected in which the powder is triboelectrically negative to the carrier. It is often desirable in any type of printing to produce a reverse copy of an original. By this is meant to produce a negative copy from a positive original or, on the other hand, a positive copy from a negative original. In electrostatographic printing, image reversal can be accomplished by applying to the image a developer powder which is repelled by the charged areas of the image and adheres to the discharged areas.

The triboelectric relationship between the electroscopic powder and the carrier depends on their relative positions in a triboelectric series in which the materials are arranged in such a way that each material is electrostatically charged with a positive charge when contacted with any material below it in the series and with a negative charge when contacted with any material above it in the series. In the reproduction of high contrast copy such as letters, tracings, etc., it is desirable to select the electroscopic powder and carrier materials so that their mutual electrification is sufficient to cause the toner particles to electrostatically cling to the carrier surface, and the degree of such electrification is normally governed by the distance between their positions in the triboelectric series, that is, the greater distance they are removed from one another, the greater the mutual electrification; and the closer they are together in the series, the less the mutual electrification.

Suitable coated and uncoated carrier materials for cascade, magnetic brush, and touchdown development are well known in the art. The carrier comprises any suitable solid material, provided that the carrier acquires a charge having an opposite polarity to that of the toner particles when brought in close contact with the toner particles so that the toner particles adhere to and surround the carrier. By proper selection of materials in accordance with their position in the triboelectric series, the polarities of their charge when the materials are mixed are such that the electroscopic toner particles adhere to and are coated on the surface of a carrier and also adhere to that portion of the electrostatic image bearing surface having a greater attraction for the toner than the carrier.

Carrier particles are generally made from or coated with materials having appropriate triboelectric properties as well as certain other physical characteristics. Thus, the materials employed as the carrier particles or the coatings thereon should have a triboelectric value commensurate with the triboelectric value of the toner to enable electrostatic adhesion of the toner to the carrier particles and subsequent transfer of the toner from the carrier particles to the image on the plate. Furthermore, the triboelectric properties of the carrier particles should be relatively uniform to permit uniform pickup and subsequent deposition of toner. The materials employed on the carrier particles should preferably have an intermediate hardness so as not to scratch the plate or drum surface upon which the electrostatic image is initially placed while being sufficiently hard to withstand the forces to which they are subjected during recycle. The carrier particles as well as the surface thereof also should not be comprised of materials which are so brittle as to cause either flaking of the surface or particle breakup under the forces exerted on the carrier during recycle. The flaking thereof causes undesirable effects in that the relatively small flaked particles will eventually be transferred to the copy surface thereby interfering with the deposited toner and causing imperfections in the copy image. Furthermore, flaking of the carrier surface will cause the resultant carrier to have nonuniform triboelectric properties when the carrier is composed of a material different from the surface coating thereon. This results in undesirable nonuniform pickup of toner by the carrier and nonuniform deposition of toner on the image. In addition, when the carrier particle size is reduced, the removal of the resultant small particles from the plate becomes increasingly difficult. Thus, the types of materials useful for making carrier or for coating carrier, although having the appropriate triboelectric properties, are limited because other physical properties which they possess may cause the undesirable results discussed above.

While ordinarily capable of producing good quality images, conventional developing materials suffer serious deficiencies in certain areas. The developing materials must flow freely to facilitate accurate metering and even distribution during the development and developer recycling phases of the electrostatographic process. Some developer materials, though possessing desirable properties such as proper triboelectric characteristics, are unsuitable because they tend to cake, bridge, and agglomerate during handling and storage. Adherence of carrier particles to reusable electrostatographic imaging surfaces causes the formation of undesirable scratches on the surfaces during the image transfer and surface cleaning steps. The tendency of carrier particles to adhere to imaging surfaces is aggravated when the carrier surfaces are rough and irregular. The triboelectric and flow characteristics of many carriers are adversely affected when relative humidity is high. For example, the triboelectric values of some carrier materials fluctuate with changes in relative humidity and are not desirable for employment in electrostatographic systems, particularly in automatic machines which require carriers having stable and predictable triboelectric values.

Another factor affecting the stability of carrier triboelectric properties is the susceptibility of carrier materials to "toner impaction". When carrier particles are employed in automatic machines and recycled through many cycles, the many collisions which occur between the carrier particles and other surfaces in the machine cause the toner particles carried on the surface of the carrier particles to be welded or otherwise forced into the carrier coatings. The gradual accumulation of permanently attached toner material on the surface of the carrier causes a change in the triboelectric value of the carrier and directly contributes to the degradation of copy quality by eventual destruction of the toner carrying capacity of the carrier.

Thus, there is a continuing need for a better developer material for developing electrostatic latent images.

SUMMARY OF THE INVENTION

It is, therefore, an object of this invention to provide developer materials which overcome the above noted deficiencies.

It is another object of this invention to provide carrier particles having more uniform triboelectric characteristics.

It is still another object of this invention to provide low density carrier particles which are more resistant to toner impaction.

It is another object of this invention to provide developer materials which flow more freely.

It is a further object of this invention to provide carrier particles which have controlled electrostatographic responses.

It is a still further object of this invention to provide improved developer materials which may be employed in positive electrostatographic development processes.

It is still another object of this invention to provide improved developer materials which may be employed in negative electrostatographic development processes.

A still further object of this invention is to provide improved developer materials having physical and chemical properties superior to those of known developer materials.

The above objects and others are accomplished, generally speaking, by providing electrostatographic composite carrier particles comprising an integral combination of two or more materials. It has been found that the use of composite carrier particles comprising an integral combination of two or more materials enables the tailoring of a carrier's electrostatographic response by the proper choice of component materials and the relative amount of each component material employed in the carrier particle composition. In addition, it has also been found that the resistivity, carrier particle density, and magnetic characteristics are some of the physical properties that can be altered and controlled by the use of the composite carrier particles of this invention. Of particular interest in the field of electrostatography is the use of low density composite carrier particles with pressure-fixable toner materials. Although pressure-fixable toner materials generally require less energy to make a permanent image during the fixing step, they generally also are more susceptible to toner impaction upon carrier materials. Thus, adverse toner-carrier interactions such as toner impaction on carrier particles is minimized by the use of the low-density composite carrier materials of this invention.

In accordance with this invention, composite materials in the form of electrostatographic carrier particles or beads are employed in electrostatographic image development systems. Composite materials are herein defined as any integral combination of two or more materials. As representative examples of composite materials there may be mentioned homogeneously dispersed fine powdered ceramic or metal oxide filler in a rubber, plastic, or ceramic matrix; organic filler which is miscible or immiscible in an organic matrix such as plastic or rubber; metal filler in a ceramic, plastic, or rubber matrix; and ceramic or metal oxide filler in a metal matrix.

Metal alloys are also contemplated to be within the definition herein of a composite material. Further, two or more physical phases of the same material within one body are considered herein as a composite material within the definition of this invention. An example of such a composite material is the presence of two or more homogeneously dispersed crystalline phases of the same material within one ceramic body such as that resulting from the heat treatment of a ceramic material. Another example of such a composite material is the product obtained by the development of a metallic oxide layer on the surface of a metal or metallic oxide carrier particle by either heat treatment or chemical reaction. A further example lies wherein a steel carrier bead may be subjected to a carburizing, nitriding, or a carbon-nitriding process thereby forming a surface layer on the steel carrier bead which is high in carbon, nitrogen, or carbon-nitrogen content, respectively. It is to be noted that such a surface layer may be controlled in thickness and content to provide the desired composite carrier particle compositions and characteristics. If desired, the entire carrier body may be diffused through with the aforementioned elements. It is further contemplated that the composite carrier materials of this invention include a magnetic additive such as fine iron powder or ceramic ferrite within a plastic or rubber matrix to provide low density composite carrier particles capable of being employed in magnetic brush development systems. It is also contemplated that composite carrier particles for positive or negative electrostatographic development systems may be provided by this invention.

In preparing the composite carrier particles of this invention in which the composite carriers are an integral combination of two or more materials, the particular components selected are dependent upon the selected toner in order that when the carrier and toner are mixed together to form a developer mixture the carrier is capable of imparting a positive triboelectric charge or a negative triboelectric charge to the toner. The components may be selected by referring to any of the triboelectric series known in the art. As representative examples of such triboelectric series, there may be mentioned the following: Shaw and Levy, E.W.L. Proc. of Royal Society, 138, p. 506 (1932); The Smithsonian series, published in Smithsonian Physical Tables, p. 375, 9th Rev. Ed. (1954); and Hersh and Montgomery Textile Research Laboratories, 28, p. 903 (1956).

As representative examples of materials which generally impart a negative charge to the toner, there may be mentioned: glass, metal oxides, such as calcium oxide, titanium oxide, iron oxide, calcium titanate, etc.; metals, such as lead, nickel, copper; ferrite; polymers such as ethyl cellulose, acrylic polymers, acrylate polymers; and the like. As representative examples of materials which generally impart a positive charge to the toner, there may be mentioned; metals such as selenium; polymers such as halopolymers; e.g., polymers of tetrafluoroethylene, polymers of vinyl chloride, polymers of vinyl fluoride, polymers of vinylidene fluoride, polymers of chlorotrifluoroethylene; butyl rubber; and the like. The selection of the required materials is deemed to be within the scope of those skilled in the art from the teachings herein.

In producing composite carriers from two or more materials, the materials selected may be intimately mixed with each other in a manner such that the domain size of each of the components is at least smaller than the average particle size of the toner to be employed by an order of at least two magnitudes, and whereby the composite is capable of imparting the desired polarity charge to the toner. It is to be understood that the domain size of each of the components could be larger than the average particle size of the toner, and in some cases, slightly smaller than the average particle size of the toner, provided the domain size is of a size sufficient to impart the desired charge to the single toner.

The intimate mixture of the two or more composite carrier components may be formed by intimately mixing the components; e.g., by milling, melt blending, impingement, kneading, alloying, heat treating, disc pelletizing, spray drying, and the like as known in the art. Alternately, one of the components may be formed with pores and vacuum impregnated or otherwise filled with the other component. It is to be understood that the domain size of each of the various components may be controlled in such techniques by selection of the particle size of the components and the pore size of the porous material, respectively. The precise method of producing an intimate mixture of at least two components is deemed to be within the scope of those skilled in the art from the teachings herein and no further explanation is deemed necessary for a complete understanding of the present invention. The relative proportions of the at least two components used in producing the composite carriers will vary with the components and toner used.

When the composite carriers of this invention are to be employed in cascade development processes, the carrier may comprise a combination of materials which is capable of imparting only a negative or positive polarity charge to a toner composition. Alternatively, the composite carrier surface only may comprise a material capable of providing such triboelectric characteristics. For magnetic brush development processes, the composite carrier may comprise a combination of materials wherein a magnetic component such as iron in particulate form or ceramic ferrites is dispersed or encased in a matrix material such as a plastic or rubber to yield a low density composite carrier material. As with composite carriers for cascade development processes, both composite carriers capable of imparting only a negative or positive polarity charge to a toner composition may be prepared for magnetic brush development systems. Thus, it will be apparent to those skilled in the art that the composite carriers of this invention may be provided having controlled electrostatographic responses and further wherein the nature of a magnetic component employed is xerographically such as not to adversely affect the electrostatographic response of the composite carrier.

The composite carrier particles of this invention may be coated with any suitable coating material. Typical electrostatographic carrier particle coating materials include vinyl chloride-vinyl acetate copolymers, styrene-acrylateorganosilicon terpolymers, natural resins such as caoutchouc, colophony, copal, dammar, Dragon's Blood, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates; thermosetting resins including phenolic resins such as phenol-formaldehyde, phenol-furfural and resorcinol formaldehyde; amino resins such as urea-formaldehyde and melamineformaldehyde; polyester resins; epoxy resins; and the like.

Many of the foregoing and other typical carrier coating materials are described by L. E. Walkup in U.S. Pat. No. 2,618,551; B. B. Jacknow et al in U.S. Pat. No. 3,526,533; and R. J. Hagenbach et al in U.S. Pat. Nos. 3,533,835 and 3,658,500. When the composite carrier particles of this invention are coated, any suitable electrostatographic carrier coating thickness may be employed. However, a carrier coating having a thickness at least sufficient to form a thin continuous film on the carrier particle is preferred because the carrier coating will then possess sufficient thickness to resist abrasion and prevent pinholes which adversely affect the triboelectric properties of the coated carrier particles. Generally, for cascade and magnetic brush development, the carrier coating may comprise from about 0.1 percent to about 10.0 percent by weight based on the weight of the coated composite carrier particles. Preferably, the carrier coating should comprise from about 0.9 percent to about 2.4 percent by weight based on the weight of the coated carrier particles because maximum durability, toner impaction resistance, and copy quality are achieved. To achieve further variation in the properties of the coated composite carrier particles, well-known additives such as plasticizers, reactive and non-reactive polymers, dyes, pigments, wetting agents and mixtures thereof may be mixed with the coating materials. An ultimate coated or uncoated composite carrier particle having an average diameter between about 50 microns and about 1,000 microns is preferred in cascade systems because the carrier particle then possesses sufficient density and inertia to avoid adherence to the electrostatic image during the cascade development process. Adherence of carrier particles to an electrostatographic drum is undesirable because of the formation of deep scratches on the drum surface during the image transfer and drum cleaning steps, particularly where cleaning is accomplished by a web cleaner such as the web disclosed by W. P. Graff, Jr., et al in U.S. Pat. No. 3,186,838.

Any suitable well-known toner material may be employed with the composite carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, polypropylene resins, epoxy resins, polyethylene resins, polyester resins, and mixtures thereof. The particular toner material to be employed obviously depends upon the separation of the toner particles from the composite carrier in the triboelectric series and should be sufficient to cause the toner particles to electrostatically cling to the carrier surface. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Reissue 25,136 to Carlson and U.S. Pat. No. 2,788,288 to Rheinfrank et al. These toners generally have an average particle diameter between about 1 and 30 microns.

Any suitable colorant such as a pigment or dye may be employed to color the toner particles. Toner colorants are well known and include, for example, carbon black, nigrosine dye, aniline black, Calco Oil Blue, chrome yellow, ultramarine blue, Quinoline Yellow, methylene blue chloride, Monastral Blue, Malachite Green Ozalate, lampblack, Rose Bengal, Monastral Red, Sudan Black BM, and mixtures thereof. The pigment or dye should be present in the toner in a quantity sufficient to render it highly colored so that it will form a clearly visible image on a recording member. Preferably, the pigment is employed in an amount from about 3 percent to about 20 percent, by weight, based on the total weight of the colored toner because high quality images are obtained. If the toner colorant employed is a dye, substantially smaller quantities of colorant may be used. Any suitable conventional toner concentration may be employed with the composite carriers of this invention. Typical toner concentrations for cascade and magnetic brush development systems include about 1 part toner with about 10 to about 200 parts by weight of carrier.

Any suitable organic or inorganic photoconductive material may be employed as the recording surface with the composite carriers of this invention. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfo-selenide, and mixtures thereof. Typical organic photoconductors include: quinacridone pigments, phthalocyanine pigments, triphenylamine, 2,4-bis (4,4'-diethyl-amino-phenol)-1,3,4-oxadiazol, N-isopropylcarbazol, triphenyl-pyrrol, 4,5-diphenylimidazolidinone, 4,5-diphenylimidazolidinethione, 4,5-bis-(4'-amino-phenyl)-imidazolidinone, 1,5-dicyanonaphthalene, 1,4-dicyanonaphthalene, aminophthalodinitrile, nitrophthalodinitrile, 1,2,5,6-tetraazacyclooctetraene-(2,4,6,8), 2-mercaptobenzothiazole-2-phenyl-4-diphenylideneoxazolone, 6-hydroxy-2,3-di(p-methoxyphenyl)-benzofurane, 4-dimethylamino-benzylidene-benzhydrazide, 3-benzylidene-amino-carbazole, polyvinyl carbazole, (2-nitrobenzylidene)-p-bromoaniline, 2,4-diphenyl-quinazoline, 1,2,4-triazine, 1,5-diphenyl-3-methyl-pyrazoline, 2-(4'-dimethylamino phenyl)-benzoxazole, 3-amine-carbazole, and mixtures thereof. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The surprisingly better results obtained with the electrostatographic composite carriers of this invention may be due to many factors. For example, the composite carriers of this invention possess smooth outer surfaces which are highly resistant to cracking, chipping, and flaking. In cascade development systems, the smooth surface enhances the rolling action of the carrier particles across the electrostatographic surfaces and reduces the tendency of carrier particles to adhere to the electrostatographic imaging surfaces. When these composite carriers are employed in electrostatographic development systems, carrier life is unexpectedly extended particularly with respect to toner impaction resistance. Additionally, the composite carrier materials of this invention appear to contribute to the stability of the triboelectric properties of the carrier over a wide relative humidity range. Because of their triboelectric properties, these carrier materials may be employed in reversal development of positively charged images. Further, the composite carriers of this invention provide more uniform triboelectric characteristics than current carriers when employed in electrostatographic development systems. In addition, the composite carriers of this invention provide exceptionally good life performance, durability, copy quality, quality maintenance, less carrier bead sticking and agglomeration, and also provide improved abrasion resistance thereby minimizing carrier chipping and flasking.

The low density composite carriers of the present invention have sufficient hardness at normal operating temperatures to prevent impaction, have triboelectric values such that they can be used with a wide variety of presently available toners in present electrostatographic processes, and are hydrophobic so that they retain a predictable triboelectric value. Thus, the composite carrier particles of this invention have desirable properties which permit their wide use in presently available electrostatographic systems.

The following examples, other than the control examples, further define, describe and compare preferred methods of utilizing the composite carriers of the present invention in electrostatographic applications. Parts and percentages are by weight unless otherwise indicated.

EXAMPLE I

Composite carrier particles are prepared by dispersing about 60 grams of powdered ferrite ceramic particles having an average particle diameter of about 1 micron in about 50 grams of polyvinylacetate solution having a solids content of about 70 percent by weight based on the weight of the polymer. The solvent is removed, the dispersion solidified, dried, comminuted, and screened to an average diameter particle size of about 100 microns. About 99 parts by weight of the resultant carrier particles are mixed with about 1 part by weight of a toner composition comprising styrene-n-butyl methacrylate copolymer, polyvinyl butyral and carbon black produced as disclosed in U.S. Pat. No. 3,079,324. The developer mixture is cascaded across an electrostatic latent image-bearing surface. The developed image is transferred by electrostatic means to a sheet of paper whereon it is fused by heat. The residual power is removed from the electrostatic imaging surface by a cleaning web of the type disclosed by W. P. Graff, Jr., et al in U.S. Pat. No. 3,186,838. The composite carrier is found to perform well and print quality is good throughout the test.

EXAMPLE II

Composite reversal carrier particles are prepared by dispersing about 60 grams of powdered ferrite ceramic particles having an average particle diameter of about 1 micron to about 50 grams of a polyvinyl chloride solution having a solids content of about 70 percent by weight based on the weight of the polymer. The solvent is removed, the dispersion solidified, dried, comminuted, and screened to an average diameter particle size of about 100 microns. A developer mixture is prepared by mixing about 99 parts by weight of the resultant carrier particles with about 1 part by weight of the toner particles of Example I. In machine tests employing magnetic brush development of a positively charged reusable imaging surface and developing discharged image areas with unexposed areas still positively charged, the composite carrier is found to perform well and reversal print quality is good throughout the test.

EXAMPLE III

Composite carrier particles are prepared by placing about 1500 grams of soft steel (AISI-C 1015) particles having an average diameter of about 100 microns in a carburizing furnace. Carbon monoxide is introduced into the furnace as a gas where the carbon is absorbed by the steel while the steel is heated to about 1400° F. to about 0.5 hours. The steel particles that have been carburized are water-quenched as they emerge from the furnace and tempered to about 350° F. Examination of the carburized steel particles shows that the carbon content at the surface of the particles is about 1 percent by weight and the steel particles to have a soft and tough core and a hard case or skin. A developer mixture is prepared by mixing about 99 parts of the resultant carrier particles with about 1 part of the toner particles of Example I and the developing procedure of Example I is followed. The composite carrier is found to perform well and print quality is good throughout the test.

EXAMPLE IV

Composite carrier particles are prepared by placing about 1500 grams of soft steel (1020 steel) particles having an average diameter of about 100 microns in a sodium cyanide bath. The steel particles are treated in the cyanide bath for about 0.25 hours at a temperature of about 1550° F. The steel particles are then removed from the cyaniding bath and immediately quenched in a water bath. Examination of the cyanide treated steel particles indicates that the hardness of the surface or case of the particles is greater than can be attributed to carbon, and a microscopic examination shows crystals of nitride intermingled with carbide. A developer mixture is prepared by mixing about 99 parts of the resultant carrier particles with about 1 part of the toner particles of Example I and the developing procedure of Example I is followed. The composite carrier is found to perform well and print quality is good throughout the test.

EXAMPLE V

Composite carrier particles are prepared by heating about 1500 grams of soft steel particles containing from about 0.9 to about 1.5 percent by weight of aluminum and having an average diameter of about 100 microns in a stream of dry ammonia gas at a temperature between about 900° and 1200° F. for about 48 hours. The ammonia is decomposed on the surface of the carrier particles and nitrogen is absorbed by the steel and aluminum to form a hard nitride. The carrier particles are cooled in the furnace to avoid scaling. A developer mixture is prepared by mixing about 99 parts of the resultant carrier particles with about 1 part of the toner particles of Example I and the developing procedure of Example I is followed. The composite carrier is found to perform well and print quality is good throughout the test. Substantially no toner impaction is observed.

EXAMPLE VI

Composite carrier particles are prepared as in Example III except that ammonia is introduced into the gaseous carburizing atmosphere of Example III and the treated particles are cooled in the furnace. Examination of the thus treated steel particles indicates that the hardness of the surface or case of the particles is greater than can be attributed to carbon, and a microscopic examination shows crystals of nitride intermingled with carbide. A developer mixture is prepared by mixing about 99 parts of the resultant carrier particles with about 1 part of the toner particles of Example I and the developing procedure of Example I is followed. The composite carrier is found to perform well and print quality is good throughout the test. Substantially no toner impaction or carrier abrasion is observed.

EXAMPLE VII

Low density composite carrier particles are prepared by melting about 600 grams of methyl methacrylate and melt blending therein about 900 grams of a soft magnetic nickel-zinc ferrite powder having an average particle diameter of about 1 micron to provide a composite having about 60 percent by weight of the ferrite powder. The mixture is cooled and formed into carrier particles having an average particle size between about 90 and about 110 microns. About 99 parts by weight of the carrier particles are mixed with about 1 part by weight of pressure fixable toner particles comprising carbon black and the reaction product of isopropylidenediphenoxypropanol and adipic acid encapsulated in polystyrene. In machine tests employing magnetic brush development of a positively charged reusable imaging surface, the low density composite carrier is found to perform exceptionally well and print quality is excellent throughout the test. Toner impaction is exceptionally low and substantially no carrier abrasion is observed.

EXAMPLE VIII

Low density composite carrier particles are prepared by blending about 1500 grams of iron powder having an average particle diameter of about 1 micron with about 1000 grams of styrene-butadiene ABA block copolymer at a temperature of about 100° C. in a multipass extruder. The mixture is then cryogenically attributed to form carrier particles having an average particle size of about 100 microns. About 99 parts by weight of the carrier particles are mixed with about 1 part by weight of the pressure fixable toner particles of Example VII and the developing procedure of Example VII is followed. The low density composite carrier is found to perform exceptionally well and print quality is excellent throughout the test. Toner impaction is exceptionally low and substantially no carrier abrasion is observed.

EXAMPLE IX

Composite carrier particles are prepared by heating glass beads having an average diameter of about 100 microns and a composition of about 42.0 percent lead oxide, about 5.6 percent barium oxide, about 18.3 percent titanium dioxide, and about 31.8 percent silicon dioxide to a temperature of about 1500° F. for about 1 hour. The beads are then cooled quickly. A significant degree of crystallization occurs as evidenced by a developed opalescence. Further, varying degrees of crystallinity may be achieved by varying the temperature and/or time of heating. Generally, maximum crystalline development results at a temperature of about 1800° C. for a period of about three hours. A developer mixture is prepared by mixing about 99 parts of the resultant carrier particles with about 1 part of the toner particles of Example I and the developing procedure of Example I is followed. The composite carrier is found to perform well and print quality is good throughout the test. Substantially no toner impaction or carrier abrasion is observed.

EXAMPLE X

Composite carrier particles are prepared by melting about 1000 grams of lead and about 1500 grams of tin. The mixture is thoroughly blended, cooled, and formed into spherical carrier particles having an average particle size of about 100 microns. About 99 parts by weight of the resultant carrier particles are mixed with about 1 part of the toner particles of Example I to form a developer mixture and employed as in the developing procedure of Example I. The composite carrier is found to perform well and print quality is good throughout the test. Substantially no toner impaction or carrier abrasion is observed.

EXAMPLE XI

Composite carrier particles are prepared by heating about 1500 grams of 1018 carbon steel particles having an average diameter of about 100 microns in a furnace operating at a temperature of about 800° F. with an ambient air atmosphere for about 15 minutes. After cooling, examination of the thus treated particles indicates that a thin, adherent iron oxide film has developed over the entire surface of the carbon steel particles. A developer mixture is prepared by mixing about 99 parts of the resultant carrier particles with about 1 part of the toner particles of Example I and the developing procedure of Example VII is followed. The composite carrier is found to perform well and print quality is good throughout the test. Substantially no toner impaction or carrier abrasion is observed.

EXAMPLE XII

Low density composite reversal carrier particles are prepared by melt-blending about 1500 grams of iron powder having an average particle diameter of about 1 micron with about 1000 grams of tetrafluoroethylene. The mixture is cooled and formed into carrier particles having an average particle diameter between about 90 and about 110 microns. About 99 parts by weight of the resultant carrier particles are mixed with about 1 part by weight of the pressure fixable toner particles of Example VII and the developing procedure of Example II is followed. The low density composite carrier is found to perform exceptionally well and print quality is excellent throughout the test. Toner impaction is exceptionally low and substantially no carrier abrasion is observed.

Although specific materials and conditions were set forth in the above examples for making and using the developer materials of this invention, these are merely intended as illustrations of the present invention. Various other toners, carrier substituents and processes such as those listed above may be substituted for those in the examples with similar results.

Other modifications of the present invention will occur to those skilled in the art upon a reading of the present disclosure. These are intended to be included within the scope of this invention.

What is claimed is:

1. An electrostatographic developer mixture comprising finely-divided toner particles electrostatically clinging to the surface of composite carrier particles, said carrier particles having an average diameter between about 50 microns and about 1000 microns, and comprising steel beads having a carburized surface layer which has high carbon content.

2. An electrostatographic developer mixture comprising finely-divided toner particles electrostatically clinging to the surface of composite carrier particles, said carrier particles having an average diameter between about 50 microns and about 1000 microns, and comprising steel beads having a nitrided surface layer which has high nitrogen content.

3. An electrostatographic developer mixture comprising finely-divided toner particles electrostatically clinging to the surface of composite carrier particles, said carrier particles having an average diameter between about 50 microns and about 1000 microns, and comprising steel beads having a carburized-nitrided surface layer which has high carbon-nitrogen content.

4. An electrostatographic image process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of composite carrier particles, said carrier particles having an average diameter between about 50 microns and about 1000 microns, and comprising steel beads having a carburized surface layer which has high carbon content, whereby at least a portion of said finely-divided toner particles are attracted to and deposited on said recording surface in conformance with said electrostatic latent image.

5. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of composite carrier particles, said carrier particles having an average diameter between about 50 microns and about 1000 microns, and comprising steel bands having a nitrided surface layer which has high nitrogen content, whereby at least a portion of said finely-divided toner particles are attracted to and deposited on said recording surface in conformance with said electrostatic latent image.

6. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of composite carrier particles, said carrier particles having an average diameter between about 50 microns and about 1000 microns, and comprising steel beads having a carburized-nitrided surface layer which has high carbon-nitrogen content, whereby at least a portion of said finely-divided toner particles are attracted to and deposited on said recording surface in conformance with said electrostatic latent image.

* * * * *